US006099101A

United States Patent [19]

Maurelli et al.

[11] Patent Number: 6,099,101

[45] Date of Patent: Aug. 8, 2000

[54] DISABLING REFILL AND REUSE OF AN INK JET PRINT HEAD

[75] Inventors: Giuseppe Andre Maurelli; Brant Dennis Nystrom; Jason Edward Singleton, all of Lexington, Ky.

[73] Assignee: Lexmark International, Inc., Lexington, Ky.

[21] Appl. No.: 09/055,868

[22] Filed: Apr. 6, 1998

[51] Int. Cl.[7] ..... B41J 2/195

[52] U.S. Cl. ..... 347/7; 399/24

[58] Field of Search ..... 347/7, 14, 85–87, 347/19; 399/24, 27

[56] References Cited

U.S. PATENT DOCUMENTS

| | | | |
|---|---|---|---|
| Re. 35,751 | 3/1998 | Midgley | 399/25 |
| 4,178,595 | 12/1979 | Jinnai et al. | 347/7 |
| 4,585,327 | 4/1986 | Suzuki | 399/26 |
| 4,751,484 | 6/1988 | Matsumoto et al. | 399/25 |
| 4,872,027 | 10/1989 | Buskirk et al. | 347/19 |
| 4,961,088 | 10/1990 | Gilliland et al. | 399/25 |
| 4,970,533 | 11/1990 | Saito et al. | 347/86 |
| 5,148,534 | 9/1992 | Comerford | 711/164 |
| 5,184,181 | 2/1993 | Kurando et al. | 399/262 |
| 5,363,134 | 11/1994 | Barbehenn et al. | 347/49 |
| 5,519,422 | 5/1996 | Thoman et al. | 347/49 |
| 5,596,388 | 1/1997 | Ohkubo et al. | 399/111 |
| 5,610,635 | 3/1997 | Murray et al. | 347/7 |
| 5,617,121 | 4/1997 | Tachihara et al. | 347/7 |
| 5,694,156 | 12/1997 | Hoisington et al. | 347/7 |

FOREIGN PATENT DOCUMENTS 4-144754 5/1992 Japan .

*Primary Examiner*—John Barlow
*Assistant Examiner*—Craig A. Hallacher
*Attorney, Agent, or Firm*—John J. McArdle, Jr.; David LaRose, Esq.

[57] ABSTRACT

The invention described in the specification relates to an apparatus and method for disabling an ink jet print head cartridge so that the disposable cartridge can not be refilled and used again. The method involves placing a monitoring and disabling device inside of the ink jet print head cartridge. When the print head has exceeded its useful life span, the disabling device disables the print head cartridge. The apparatus consists of a set of electrically charged capacitors, a small processor, ink sensors, and an extra long life miniature battery. A card containing the battery, processor and capacitors is placed in the ink jet print head cartridge. A sensor is placed in the bottom of each ink well of the cartridge. The processor periodically checks the level of ink in each inkwell. Once the processor determines that a specific inkwell has been empty for a certain period of time, the capacitors are discharged to the section of the nozzle plate corresponding to the expended inkwell. The capacitors discharge with a strong enough current and for a long enough time to render the nozzles permanently inactive.

24 Claims, 3 Drawing Sheets

DISABLING REFILL AND REUSE OF AN INK JET PRINT HEAD

FIELD OF THE INVENTION

The invention relates to a method and apparatus for disabling the refill and reuse of an expended or expired ink jet print head cartridge. More particularly, it relates to the discharging of capacitors to send a relatively strong current to the nozzle plate of the print head cartridge that will disable the nozzle resistors when it is determined that the useful life of the ink jet print head cartridge has expired.

BACKGROUND OF THE INVENTION

Ink jet type printers employ a print head that consists of a reservoir of ink and a series of nozzles on a semiconductor substrate that are used to expel the ink onto a printing surface. The ink is drawn to the substrate through channels and then expelled through the nozzles. Some types of ink jet printers expel the ink by superheating a small portion of the ink with an electric nozzle resistor located in a chamber beneath the nozzle. The boiling ink forms an expanding bubble which propels a drop of ink through the nozzle and onto the printing surface. In other types of ink jet printers, piezoelectric transducers that change their dimensions in response to an electric field are used to essentially squeeze a drop of ink through the nozzle. The number, spacing, size and condition of the nozzle holes greatly influences the print quality. By carefully controlling the expulsion of the ink through the nozzles and onto a printing surface, a high quality image can be created. For color printing applications, the three primary colors of cyan, magenta and yellow are provided by ejecting ink through nozzles or holes associated with the inkwell or print head containing each of the primary colors.

Due to the limited life span of the ink jet nozzles and other components of an ink jet print head cartridge, the print head cartridges are generally designed to be disposable. However, in recent years, a growing number of ink jet users have started having their empty ink jet print head cartridges refilled by a third party. This practice has resulted in poor print quality and may lead to a much shorter printer life span.

Inks formulated by the printer manufacturer or its affiliates have undergone extensive testing and analysis. The inks are designed and manufactured to produce the highest possible print quality with the least amount of corrosion to the internal printer components. Refilling an expended ink jet print head cartridge with an untested ink may result in poor print quality for several reasons. First, the nozzles begin to wear out and become clogged after what is basically a set number of fires. Continually refilling the ink jet print head with ink results in an ever increasing number of ineffective or unfiring nozzles. When even a few nozzles fail to fire, the degradation of output print quality is quite evident. The combination of exceeding the nozzle plate life and using inferior inks that clog the nozzles more readily than manufacturer's inks results in an unacceptable number of clogged nozzles and poor print quality. In addition, the manufacturer's printer driver color tables are set up specifically for the manufacturer's inks. Thus, even a slight change in the hue of even one ink can have a drastic effect on print quality. The manufacturer's inks are also made to have a certain density and cohesion so they will blend correctly on all paper types. By using a third party's ink, the print dots will blend unpredictably, resulting in banding, running and smearing. Finally, refilling an ink jet print head cartridge designed to be disposable with a third party's inks may result in a shorter life span for some of the ink jet printer's hardware. Some untested inks are caustic to internal printer components that come into contact with the ink. The maintenance station and the maintenance station wiper come into direct contact with the ink and, thus, can become permanently damaged by the use of inferior inks. If the maintenance station does become damaged by using these inks, the nozzle plate will not be properly cleaned. This will result in poor print quality in all future printouts, even if a new print head cartridge from the manufacturer is subsequently used.

Many consumers assume that it must be all right to have their ink jet print head cartridges refilled because the refilling tools and service are so readily available. Thus, when the printer becomes damaged and malfunctions as a result of using a refilled ink cartridge, the consumer is often just as likely to blame to the manufacturer as they are to blame the refilled ink jet print head cartridge. Thus, the manufacturer's reputation may be undesirably damaged by the third party's actions.

In some applications, it may even be desirable to disable an ink jet print head before the nozzles or the print quality degrades. For example, certain ink jet print heads may be used in postal metering situations were it is desirable to limit the number of times a particular ink jet cartridge can be used. As a further example, an ink jet printer could be rented to a user for a specified amount of time or number of uses. When the specified number of uses is exceeded, the ink jet print head needs to be disabled to prevent the user from printing extra copies.

Therefore, there is a need for an efficient, inexpensive method and apparatus for disabling the refill of expired ink jet print head cartridges. The method and apparatus should provide a way to determine when an ink jet print head has reached the end of its useful life. When this determination is made, the ink jet print head cartridge should be permanently disabled. In addition, the method and apparatus is preferably self-contained in the ink cartridge so that the technology is backwards compatible with older ink jet printers without substantially modifying the print carriage.

SUMMARY OF THE INVENTION

With regard to the above and other advantages, the invention provides a method of preventing an expired color ink jet print head cartridge from being reused or refilled. A monitoring and disabling device is placed inside the ink jet print head cartridge. The amount of ink remaining in each inkwell of the color ink jet print head cartridge is periodically sensed. When it is determined that an inkwell that corresponds to a set of nozzle resistors has been empty for a certain period of time, capacitors are discharged to produce an electric current that is strong enough and lasts a long enough amount of time to permanently disable the set of nozzle resistors corresponding to the inkwell that it has been determined is empty. The periodic sensing, determining and discharging steps of the method are repeated until all of the inkwells of the ink jet print head cartridge are empty and their corresponding nozzle resistors have been disabled.

In another aspect, the invention provides a method of preventing an ink jet print head cartridge from being reused or refilled with ink. In accordance with the method, the amount of ink remaining in the ink jet print head cartridge is monitored to determine when the useful life of the ink jet print head cartridge has expired. In a preferred embodiment, the useful life of the print head cartridge depends upon the amount of ink remaining in the print head cartridge. However, in other embodiments, the useful life of the print head cartridge is measured in terms of the number of nozzle resistor firings, the amount of time that has passed since the print head cartridge was manufactured, the amount of time the print head cartridge has been is use, or any of a variety of other criteria. Regardless of how useful life is measured, when the useful life of the ink jet print head cartridge has expired, the print head cartridge is disabled. In an especially preferred embodiment, the ink jet print head cartridge is disabled by sending an electric current to the nozzle plate of the ink jet print head cartridge that is sufficient to render the nozzle resistors permanently disabled.

In another preferred embodiment, the amount of ink remaining in the ink jet print head cartridge is monitored by periodically sensing the amount of ink remaining in the ink well of the print head. However, the amount of ink remaining in the ink jet print head cartridge can also be monitored by counting or calculating the number of drops expelled from the ink jet print head cartridge. In an especially preferred embodiment the amount of ink remaining is measured by both counting the number of drops of ink expelled from the nozzles and sensing the amount of ink remaining in the inkwell. By counting the number of expelled drops in addition to sensing the ink level and comparing the two measurements before disabling the print head, the likelihood of prematurely disabling the print head may be diminished. The likelihood of prematurely disabling the print head can also be reduced by using multiple sensors to detect the ink level in the inkwell and not disabling the print head until all of the sensors fail to detect any ink.

Yet another aspect of the invention provides a method of selectably limiting the amount an ink jet print head cartridge containing nozzles can be used. In accordance with this method, it is determined when the ink jet print head cartridge nozzles should be disabled. The disabling determination could be based upon the ink level in the cartridge, the number of nozzle resistor firings, the amount of time the cartridge has been used, or simply the amount of time that has passed. Once it has been determined when the nozzle resistors should be disabled, the amount the ink jet print head cartridge can be used before the cartridge is disabled is selectably set. When the time has come for the ink jet print head cartridge nozzles to be disabled, an electric current is sent to the ink jet print head cartridge that is strong enough to permanently disable the nozzle resistors from properly functioning.

Yet another aspect of the present invention provides a method of monitoring the monitoring and disabling device to insure that it is functioning properly and has not been disabled or tampered with itself. In a preferred embodiment, this is accomplished by combining the monitoring of the amount of ink in the inkwell with counting the number of times the nozzle resistors have fired. The results of the two measurements can be compared to determine if they correspond. If the measurements indicate the disabling circuit has been tampered with, the nozzle resistors may be disabled. Additionally, a sensor can be used to indicate whether or not the print head cartridge has been opened in an attempt to refill the cartridge. If the sensor indicates the print head cartridge has been opened, the nozzle resistors are disabled. Another method of preventing tampering with the disabling device involves providing an electrical connection from the printer electronics to the processor of the disabling device. The printer electronics can then send a polling signal to the processor. In response to the polling signal, the processor sends a signal to the printer electronics indicating it is functioning properly. If the signal is not received by the printer electronics in response to sending the polling signal the printer electronics will not initiate printing using the ink jet print head.

The present invention further encompasses an apparatus for preventing an ink jet cartridge from being reused. The apparatus has at least one sensor for measuring the amount of ink remaining in an ink jet print head cartridge. A card is electrically connected to the sensor and constructed to fit inside the ink jet print head cartridge. The card has a processor for periodically checking the sensor output and determining when to disable the ink jet print head cartridge. To disable the print head, capacitors discharge a current sufficiently strong enough to permanently disable the ink jet print head cartridge. A battery powers the processor. Preferably, the capacitors are installed charged. However, the capacitors may be charged by the battery. The apparatus may be used in conjunction with an ink jet print head cartridge that has a plurality of inkwells and multiple sensors for detecting the amount of ink remaining in the multiple ink wells.

Another apparatus for disabling the functioning of an ink jet print head cartridge containing nozzles is also provided by the present invention. The apparatus has at least one sensor for sensing the amount of ink remaining in an ink jet print head cartridge. An electrical connection to a printer provides power to the apparatus. Preferably, at least one capacitor is provided that is capable of discharging a current sufficient to disable the ink jet print head cartridge. The preferred embodiment of the present invention also includes an electrical connection from the apparatus to ink jet printer electronics that is used to send a status signal to the printer electronics in response to receiving a polling signal from the printer electronics. The printer electronics use the status signal to determine whether or not the disabling apparatus is functioning properly and to insure that the disabling device itself has not been disabled. The present invention further envisions that the apparatus may have a processor containing circuitry that programmably limits the functioning of the ink jet print head cartridge to a specified amount of use.

The aforementioned embodiments of the apparatus and method of the present invention provide an effective and cost efficient way to disable the reuse or refill of ink jet print head cartridges. Accordingly, the present invention also allows for the metered use of ink jet cartridges. Most importantly, the present invention prevents a manufacturer's reputation from being damaged as the result of a third party's actions. Thus, the present invention is a significant improvement over the prior art.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1:
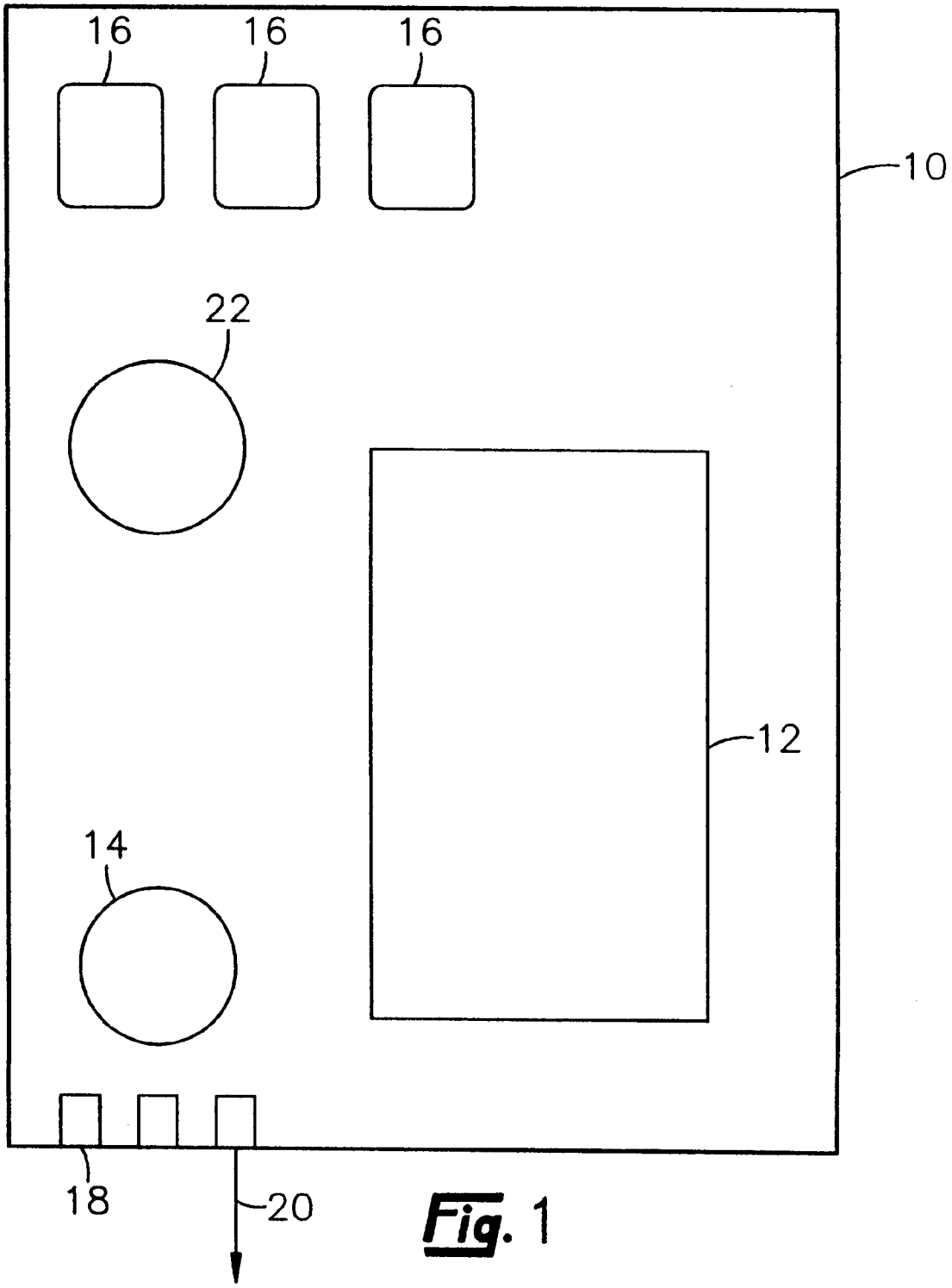
FIG. 1 is a pictorial representation of a card designed to be inserted inside an inkwell of an ink jet print head cartridge.

With reference now to FIG. 1, there is shown a diagram of an apparatus for disabling the refill of an ink jet cartridge.

The particular embodiment shown is mounted on a card 10 that is placed inside the ink jet print cartridge. The apparatus of FIG. 1 is preferably designed to fit entirely inside of the ink jet print head cartridge. Often, the print head cartridge is placed in a print head holder that is designed to receive a print head cartridge of a certain size and shape. Placing the card 10 completely inside of the print head cartridge insures that the outside dimensions of the print head cartridge are not altered. This is desirable because it allows the card 10 to be installed in print head cartridges designed before the disabling apparatus was invented. However, it should be appreciated that ink jet printers could also incorporate a print head disabling system that was not completely contained inside the print head cartridge.

The print head cartridge disabling card 10 preferably contains a small processor 12 which is electrically connected to a sensor 14. The sensor 14 produces signals corresponding to the condition of the print head cartridge inkwell into which the card 10 is inserted. As discussed in more detail below, different types of sensors 14 could be employed to produce different types of signals depending upon the circumstances under which it is desired to disable the ink jet nozzles. The processor 12 receives the signals from the sensor 14. Generally, the signals from the sensor 14 indicate how much ink is remaining in the inkwell. However, as previously discussed, the invention could be used to disable the ink jet print head cartridge after a set number of nozzles had been fired or after a set amount of usage time has expired. Thus, the type of sensor 14 deployed will depend upon the criteria used to determine when to disable the print head cartridge. If the print head cartridge is to be disabled after firing its nozzles a set number of times, the sensor 14 should be designed to sense the number of times the nozzles have been fired. Similarly, if the print head cartridge is to be disabled after a set amount of usage time, the sensor 14 should sense when the print head cartridge is in use. A variety of other types of sensors 14, such as spot sensors, capacitance based sensors, or thermistors, could be used in accordance with the present invention and it is understood that the invention is not limited to any particular type of sensor 14. In a particularly preferred embodiment, the sensor 14 is a basic liquid/vapor sensor made by Gems Sensors Inc. and designed to measure the ink level in the well by conductivity.

The processor 12 monitors the output of the sensor 14 to determine when to disable the ink jet print head cartridge. When the sensor's 14 output indicates the time is right, the processor 12 sends a signal that causes the capacitors 16 to discharge a current to the nozzle resistors of the print head cartridge. Because the capacitors 16 in the embodiment shown are located on the card 10 inside the print head cartridge and the nozzle resistors are located outside of the print head cartridge, an electrical connection must be established between the capacitors 16 and the nozzle resistors. The electrical connection between the capacitors 16 and the nozzle resistors can be completed in a number of ways. For example, the capacitors 16 could be electrically connected to a connection plate 18 located on the card 10 which would come into electrical contact with another connection plate located in the print head cartridge inkwell when the card 10 is inserted into the ink jet print head cartridge. The connection plate located in the inkwell of the print head cartridge is electrically connected to the nozzle resistors of the print head cartridge. The current can then flow from the capacitors 16 to the nozzle plate of the ink jet cartridge. However, it should be appreciated that there are many alternative ways in which the capacitors 16 could be connected to the nozzle resistors on the nozzle plate.

The strong current created by the capacitors 16 disables the nozzles resistors by melting them like a fuse, thereby creating either a short or open circuit where the nozzle resistor used to be. Therefore, the connection path 20 between the capacitors 16 and the nozzle resistors should be able to carry enough current from the discharging capacitors 16 to the nozzle resistors to cause the nozzle resistors to be permanently disabled. The exact amount of current necessary to disable the nozzle resistors depends upon the construction of the nozzle resistors. An especially preferred array of capacitors 16 produces a peak current of 709 mAmp that lasts for about 20 msec.

In the case of a color ink jet printer, the ink jet print head cartridges often have multiple inkwells to individually hold the three primary colors of cyan, magenta and yellow. A card 10, as shown in FIG. 1, could be placed in each inkwell of a color ink jet print head cartridge. Alternatively, the card 10 could be placed in one inkwell and additional sensors 14 could be placed in each additional inkwell of the color ink jet print head cartridge. The sensors 14 would be electrically connected to the card 10 and the processor 12. When the sensor 14 of one inkwell indicated that the inkwell was empty, the processor 12 would signal the capacitors 16 to discharge.

As previously discussed, the processor 12 acting in concert with the sensor 14 can be programmed to disable the print head cartridge nozzles upon the occurrence of a number of different events. For example, the processor 12 could be electrically connected to a sensor 14 that sensed the number of times the ink jet nozzle resistors had been fired. When the processor 14 determined that more than a certain number of firings had occurred, the processor 14 could signal the capacitors 16 to discharge and disable the nozzle resistors. The number of times the nozzles were allowed to fire before the capacitors are discharged could be based upon the approximate number of firings required to expend the print head cartridges ink supply. Alternatively, the number of firings could be preprogrammed to function as a debit card thereby allowing a purchaser of the cartridge a predetermined number of nozzle resistor firings before the print head cartridge becomes unusable.

Monitoring the number of times the nozzle resistors have fired is also an effective way to insure the print head cartridge has not been refilled before the ink reached a low enough level to trigger the discharge of the capacitors 16. For example, suppose an ink jet nozzle resistor has to fire approximately 150,000 times to empty an inkwell of an ink jet print head cartridge. If the nozzle resistor has fired 300,000 times and the processor has never received an empty signal from a sensor 14, it is reasonable to assume the inkwell has been refilled, or the sensor 14 disabled. Likewise, if an ink level sensor 14 indicates the inkwell is empty and a firing sensor 14 indicates the nozzle resistor has fired only 1000 times, it might be desirable to either ignore or recheck the ink level sensor 14. Thus, combining counting the number of times the nozzle resistors fire with sensing the amount of remaining ink decreases the likelihood the disabling circuit will be bypassed or malfunction.

The particular method of preventing the print head cartridge from operating may vary. The processor 12 could be in electrical communication with the printer electronics. The printer electronics would send a polling signal to the processor 12. If the print head cartridge is not expended or expired, the processor 12 sends back a signal indicating that printing may begin. However, if the print head cartridge is expired or expended, the processor 12 will not respond to the polling signal and the printer electronics will not initiate a printing operation.

In the embodiment shown in FIG. 1, a small long life battery 22 is used to power the processor 12. Additionally, if the capacitors 16 are not charged before they are installed, the battery 22 can be used to charge the capacitors 16. The battery 22 should last long enough so that the chance of the battery 22 going dead before the ink cartridge is empty is minimized.

Figure 2:
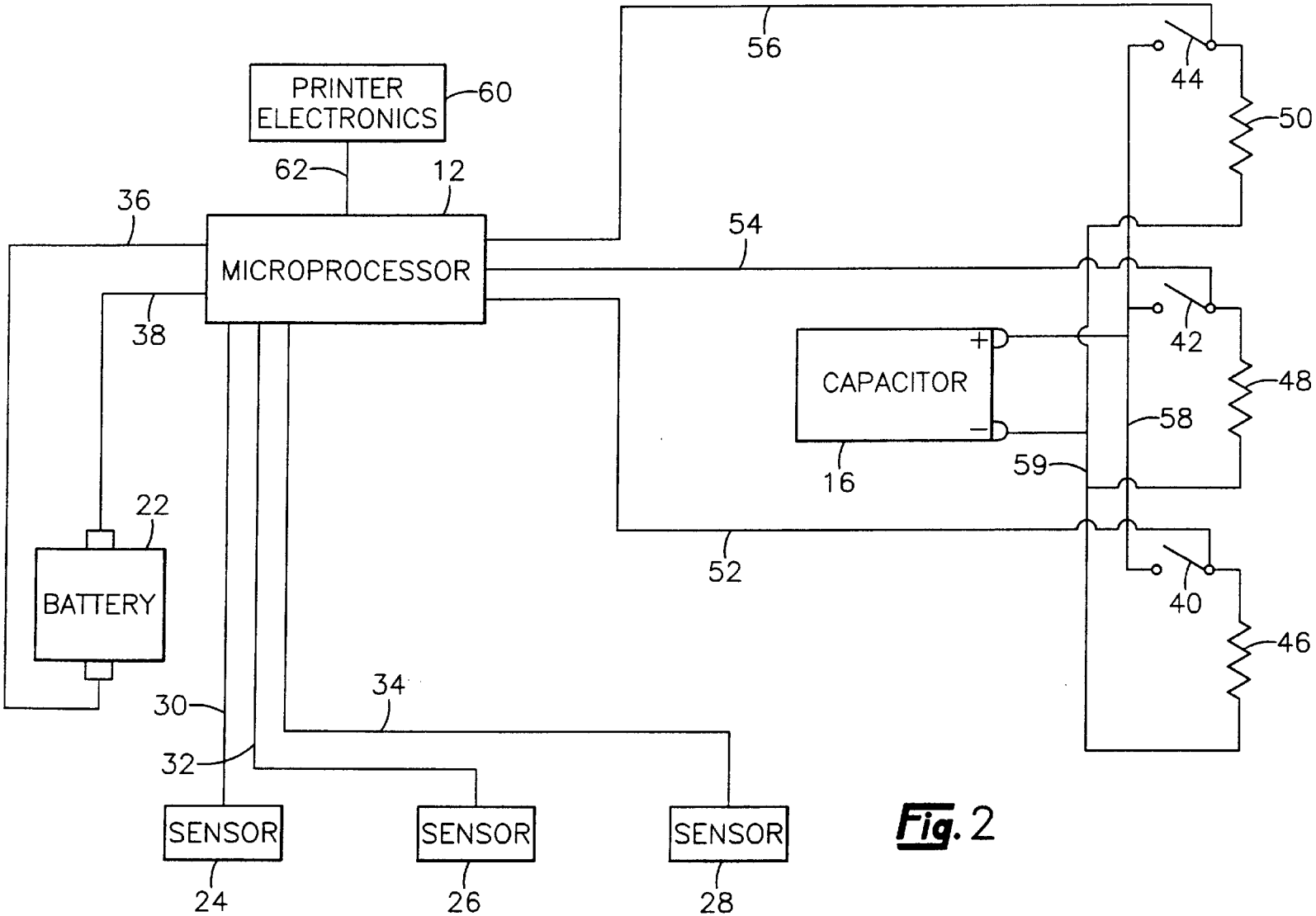
FIG. 2 is a schematic representation of the circuit elements and electrical connections needed to implement an especially preferred embodiment of the present invention in a color ink jet print head.

FIG. 2 is a schematic representation of the circuit elements and electrical connections needed to implement an especially preferred embodiment of the print head cartridge disabling circuit in a color ink jet printer. As previously discussed, there are typically three separate inkwells in a color ink jet print head cartridge containing the three primary colors cyan, magenta and yellow. The microprocessor 12 is connected to three sensors 24, 26 and 28 by conductive lines 30, 32 and 34. One of the sensors 24, 26 and 28 is located inside each inkwell of the color ink jet print head cartridge. The conductive lines 30, 32 and 34 allow the processor 12 to periodically take a sensor 24, 26 or 28 reading and determine the status of the respective inkwell. It should be appreciated that additional sensors 24, 26 and 28 could be placed inside of the inkwell to decrease the likelihood of a false reading resulting in the premature disabling of the print head cartridge.

Still referring to FIG. 2, the processor 12 is preferably powered through conductive lines 36 and 38 by a battery 22. In order to conserve the battery's 22 power, the processor 12 is placed in a low power consumption mode for a majority of the time. The processor 12 preferably has an internal clock which allows the processor 12 to turn on at predetermined intervals. The length of the intervals will depend upon the power consumption of the print head disabling circuit and the storage capacity of the battery 22. When the predetermined amount of time has passed, the processor 12 will turn on and take a reading from each of the sensors 24, 26 and 28. If one of the sensors 24, 26 and 28 produces a reading that indicates its respective inkwell is empty, the processor 12 will store a bit of data indicating that an empty reading was received from the sensor 24, 26 or 28. Preferably the processor 12 will not attempt to disable the print head until a predetermined number of empty readings have been received from the sensor 24, 26 or 28. The purpose of waiting to disable the print head until a certain number of empty readings have been received is to minimize the likelihood that an erroneous sensor 24, 26 and 28 reading will result in the print head cartridge being prematurely disabled.

The processor 12 is also electrically connected to three switches 40, 42 and 44 by conductive lines 52, 54 and 56. By sending a signal on one of the conductive lines 52, 54 or 56, the processor 12 can cause the respective switch 40, 42 or 44 to either open or close. The switches 40, 42 and 44 have two sides. One side of each switch 40, 42 or 44 is electrically connected to a set of nozzle resistors 46, 48 or 50 that correspond to a particular one of the three print head cartridge inkwells. The other side of the switches 40, 42 and 44 are electrically connected to a terminal of a capacitor 16 by a conductive line 58. The other terminal of the capacitor 16 is electrically connected by conductive line 59 to one side of the nozzle resistors 46, 48 and 50 so that the nozzle resistors 46, 48 and 50 appear as a resistance between the terminals of the capacitor 16 when the switch 40, 42 or 44 that corresponds to the particular set of nozzle resistors 46, 48 and 50 is closed. The capacitor 16 is preferably installed fully charged so that it is not necessary to provide any power to charge the capacitor 16. However, the terminals of the capacitor 16 could be electrically connected to the terminals of battery 22 so that the battery charges the capacitor 16.

Once the predetermined number of empty readings have been received from sensor 24, 26 or 28, the processor 12 sends a signal to the appropriate switch 40, 42 or 44 corresponding to the empty inkwell that causes the switch 40, 42 or 44 to close. When the switch 40, 42 or 44 closes, the capacitor 16 discharges current through the nozzle resistors 46, 48 or 50 of the empty inkwell. The capacitor 16 chosen should be large enough to produce a current that will permanently disable the ink jet nozzle resistors 46, 48 or 50 when the respective switch 40, 42 or 44 is closed. Typically, a current of about 709 mAmp that lasts at least 20 millisecs will be strong enough to destroy the ability of the nozzle resistors 46, 48 or 50 to function properly. A capacitor of 395 microfarads charged with a voltage of 20 volts will discharge a peak current of 710 mAmp through a set of nozzles having a resistance of 28.2 ohms.

As a further example, referring to FIG. 2, suppose the processor 12 was programmed to disable the appropriate nozzle resistors 46 after receiving three consecutive readings corresponding to an empty inkwell from a sensor 24. When sensor 24 provided three empty signals in a row, the processor 12 would send a signal to the switch 40 that corresponds to the nozzle resistors 46 connected to the inkwell in which the sensor 24 is located. The signal would cause switch 40 to close and, thus, the capacitor 16 would discharge across the nozzle resistors 46. The discharging of the capacitor 16 to the nozzle resistors 46 would permanently disable the nozzle resistors 46 and prevent the inkwell associated with the nozzle resistors 46 from firing.

In the embodiment shown in FIG. 2, an electrical connection 62 places the processor 12 in electrical communication with the printer electronics 60. The printer electronics 60 send a polling signal to the processor 12. If the processor 12 is functioning correctly and does not detect a problem with the sensors 24, 26 and 28, the processor 12 sends a status signal to the printer electronics 60. If the printer electronics 60 receive the desired status signal, printing operations are allowed to continue. However, if the printer electronics 60 do not receive the appropriate status signal, the printer electronics 60 will not allow printing operations to continue until a print head cartridge with a properly functioning disabling circuit is installed in the print head carrier. Thus, through electrical connection 62, the printer electronics 60 can monitor the disabling apparatus to insure it has not been disconnected or modified.

Figure 3:
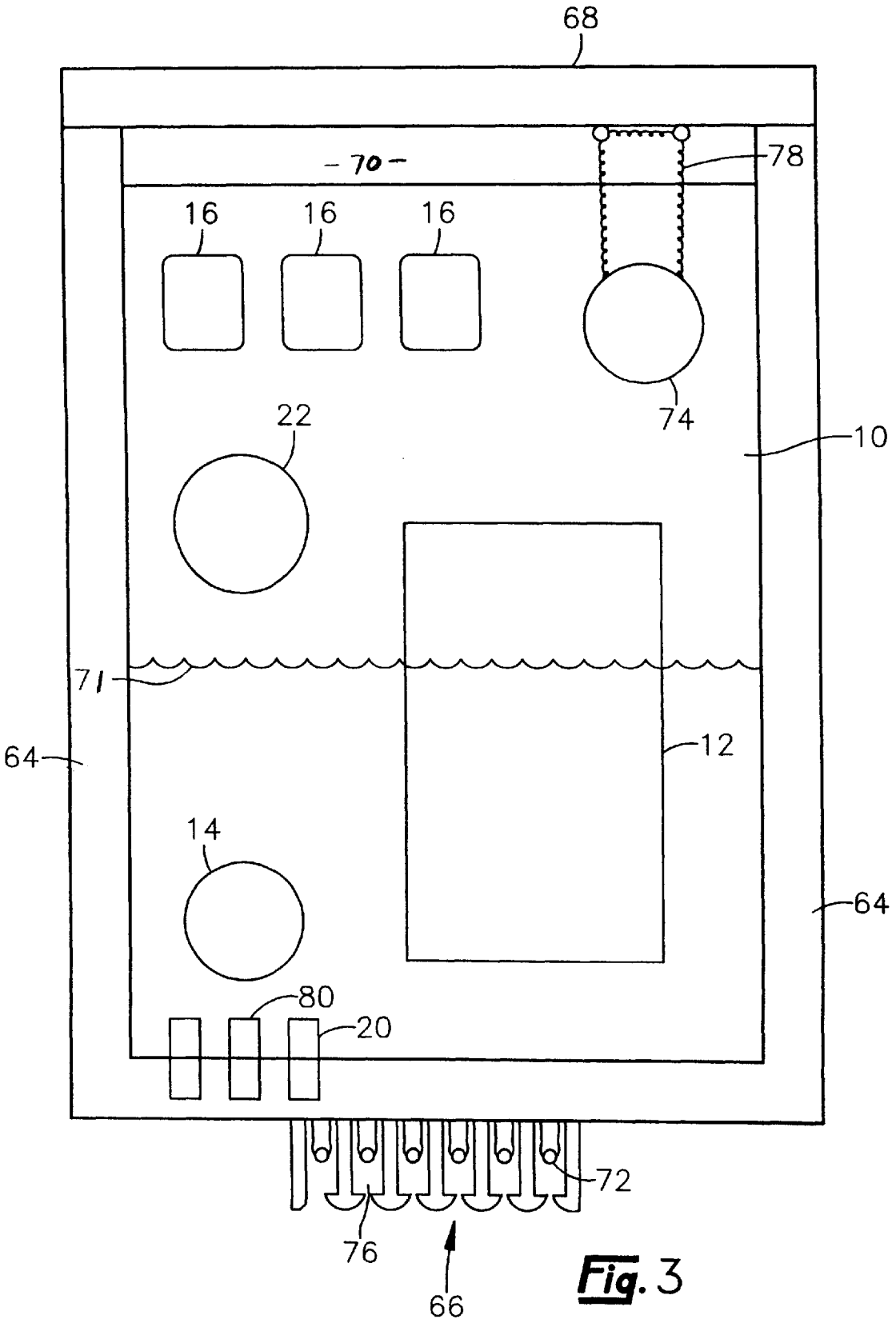
FIG. 3 is a cut away view of a print head disabling card inserted into a print head cartridge.

FIG. 3 is a simplified cut away view of an ink jet print head cartridge disabling card 10 placed inside of a single chamber print head cartridge 64. The single chamber print head cartridge 64 contains an ink reservoir 70 with a lid 68 that prevents the ink 71 contained in the reservoir 70 from spilling out. The single chamber print head cartridge 64 also has a series of nozzles 66 attached to its bottom portion. For the sake of simplicity, FIG. 3 contains a very small number of nozzles 66 and nozzle resistors 72. An actual nozzle plate would probably contain many more nozzles 66 and nozzle resistors 72. The nozzle resistors 72 are contained inside a chamber 76 that is filled with ink from the print head cartridge's 64 ink reservoir 70. When the nozzle resistor 72 heats up, it boils a small portion of ink. The resulting expansion of the boiling ink expels a drop of ink through the nozzle 66 opening.

In the embodiment shown in FIG. 3, the card 10 inserted in the print head cartridge 64 has a processor 12 for analyzing information received from two sensors 14 and 74. The sensors 14 and 74 are placed so that, no matter which edge the print head cartridge is resting on, one sensor will always detect the presence of any ink 71 in the reservoir 74.

If the processor 12 is programmed to disable the nozzle resistors 72 only when a predetermined number of consecutive empty readings have been received from both of the sensors 14 and 74, the likelihood of prematurely disabling the nozzle resistors 72 is diminished. It should be understood that a variety of sensor 14 and 74 placements and configurations could be implemented to prevent the premature disabling of the nozzle resistors 72 and the particular configuration of FIG. 3 is described for illustration purposes only.

The sensor 74 shown in FIG. 3 is also configured to prevent tampering with the print head cartridge disabling system. An easily breakable wire loop 78 is connected from terminals on the sensor 74 to the lid 68 of the print head cartridge 64. If the lid is removed, the wire loop 78 is broken. The sensor 74 detects the open circuit between the ends of the wire loop 78 and signals the processor 12 to disable the nozzle resistors 72. This prevents a user from refilling the print head cartridge 64 with ink before the sensors 14 and 74 detect an empty condition.

Another way of insuring that the print head disabling system has not been circumvented is to provide a communication line 80 from the processor 12 on the card 10 to the printer electronics. The printer electronics use the communication line 80 to periodically poll the processor 12. In response to the polling, the processor 12 checks the sensors 14 and 74 to insure they have not been disconnected or otherwise tampered with. If the processor 12 does not detect any problems, the processor 12 sends a code to the printer electronics indicating that the disabling circuit is functioning. If no code is received by the printer electronics, the printer electronics will refuse to print using the unresponsive print head cartridge. This system prevents users from disabling the disabling circuit itself. There are numerous other ways, such as counting the number of nozzle resistor 72 firings, to prevent the disabling circuit from being tampered with and the above described methods are listed for illustration purposes only.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A method of preventing an expired color ink jet print head cartridge having nozzle resistors from being reused or refilled, the steps of the method comprising:

placing a monitoring and disabling device inside the ink jet print head cartridge;

periodically sensing an amount of ink remaining in each inkwell of the color ink jet print head cartridge;

determining when an inkwell that corresponds to a set of nozzle resistors has been empty for a certain period of time; and disabling the set of nozzle resistors corresponding to the inkwell that has been determined to be empty.

2. The method of claim 1 further comprising repeating the periodic sensing, determining and disabling steps of the method until all of the inkwells of the ink jet print head cartridge are empty and their corresponding nozzle resistors have been disabled.

3. The method of claim 1 wherein disabling the nozzle resistors further comprises discharging capacitors to the nozzles resistors to destroy the nozzle resistors' ability to function properly.

4. The method of claim 1 further comprising:

counting the number of times the nozzle resistors corresponding to an inkwell have been fired;

comparing the number of times the nozzle resistors have been fired to a number representing the approximate number of nozzle resistor firings necessary to empty the inkwell corresponding to the nozzle resistors to determine the amount of ink remaining in the inkwell corresponding to the nozzle resistors;

determining if the ink level that was sensed agrees with the ink level reading based on the number of nozzle resistor firings; and disabling the nozzle resistors if both the sensed ink level reading and the ink level reading based on the number of nozzle resistor firings indicate that the ink well is empty.

5. A method of preventing an ink jet print head cartridge containing nozzle resistors and an inkwell from being reused or refilled with ink once the cartridge has reached a predetermined useful life comprising:

providing an ink jet print head cartridge containing a disabling device placed inside the ink jet print head cartridge;

monitoring the amount of ink remaining in the inkjet print head cartridge;

determining when the useful life of the ink jet print head cartridge has expired; and disabling the ink jet print head cartridge using the disabling device when the useful life of the ink jet print head cartridge has expired.

6. The method of claim 5 wherein disabling the ink jet print head cartridge further comprises sending an electric current to the nozzle resistors of the ink jet print head cartridge that is sufficient to render the nozzle resistors permanently disabled.

7. The method of claim 5 wherein monitoring the amount of ink remaining in the ink jet print head cartridge is accomplished by periodically sensing the amount of ink remaining in the inkwell of the cartridge.

8. The method of claim 5 wherein monitoring the amount of ink remaining in the ink jet print head cartridge is accomplished by counting or calculating a number of drops expelled from the ink jet print head cartridge.

9. The method of claim 5 wherein the inkjet print head cartridge also includes a monitoring device inside of the ink jet print head cartridge.

10. The method of claim 9 further comprising monitoring the monitoring and disabling devices to insure that they are functioning properly and have not been disabled.

11. The method of claim 5 wherein the step of determining when the useful life of the ink jet print head cartridge has expired further comprises assigning a number of uses to the ink jet print head cartridge and determining when that amount of uses has been reached or exceeded.

12. An ink jet print head cartridge comprising:

a printhead containing nozzle resistors, a supply of ink, at least one ink inkwell for containing the ink;

at least one sensor for measuring the amount of ink remaining in the ink well; and a card constructed to fit inside the ink well, the card comprising:

a sensor for producing a sensor output;

a processor for periodically checking the sensor output and determining when to disable the ink jet print head cartridge and for producing a disable signal;

a power supply responsive to the disable signal for discharging a current sufficient to disable the print head; and a battery for powering the processor.

13. The apparatus of claim 12 wherein the ink jet print head cartridge has a plurality of inkwells.

14. An apparatus for disabling the functioning of an ink jet print head cartridge containing nozzle resistors, the apparatus comprising:

at least one sensor for sensing the amount of ink remaining in an ink jet print head cartridge and producing and ink level signal;

a processor for receiving the ink level signal, determining when to disable the ink jet print head cartridge and producing a disable signal; and disabling means placed inside the ink jet print head cartridge the disabling means being responsive to the disable signal for permanently disabling the functioning of the ink jet print head cartridge.

15. The apparatus of claim 14 further comprising an electrical connection to a printer for providing power to the apparatus.

16. The apparatus of claim 14 further comprising a battery for supplying power to the apparatus.

17. The apparatus of claim 14 wherein the disabling means further comprise at least one capacitor for discharging a current sufficient to disable the ink jet print head cartridge.

18. The apparatus of claim 14 further comprising an electrical connection to ink jet printer electronics for receiving a polling signal from the ink jet printer electronics and for providing a status signal to the ink jet printer electronics in response to the polling signal wherein the ink jet printer electronics examine the status signal to determine whether or not the disabling apparatus is functioning properly and to insure that the disabling means itself has not been disabled.

19. The apparatus of claim 17 wherein the disabling means comprises a card containing the processor and the at least one capacitor.

20. The apparatus of claim 14 further comprising multiple sensors for detecting an amount of ink remaining in multiple ink wells.

21. The apparatus of claim 14 wherein the processor further comprises programmable circuitry that limits the functioning of the ink jet print head cartridge to a specified amount of use.

22. A method of limiting the amount of time an ink jet print head cartridge containing nozzles can be used, the method comprising providing an ink jet print head cartridge containing a disabling device card inside of the ink jet print head cartridge, determining when the ink jet print head cartridge nozzles should be disabled and, when it is determined that the inkjet print head cartridge nozzles should be disabled, sending an electric current to the ink jet print head cartridge that is strong enough to permanently disable the nozzles from properly functioning.

23. The method of claim 22 further comprising selectably setting an amount of time the ink jet print head cartridge can be used before the cartridge is disabled.

24. The method of claim 22 further comprising detecting whether or not the print head cartridge gas been opened and, if the cartridge has been opened, sending a current to the ink jet print head cartridge that is strong enough to permanently disable the nozzle resistors.

* * * * *